US011162483B2

(12) United States Patent
Yang

(10) Patent No.: US 11,162,483 B2
(45) Date of Patent: Nov. 2, 2021

(54) MORTISE-TENON JOINTED AIR PUMP

(71) Applicant: JIAO HSIUNG INDUSTRY CORP., New Taipei (TW)

(72) Inventor: Yung-Hao Yang, New Taipei (TW)

(73) Assignee: JIAO HSIUNG INDUSTRY CORP., New Taipei (TW)

( * ) Notice: Subject to any disclaimer, the term of this patent is extended or adjusted under 35 U.S.C. 154(b) by 169 days.

(21) Appl. No.: 16/120,670

(22) Filed: Sep. 4, 2018

(65) Prior Publication Data

US 2020/0011310 A1 Jan. 9, 2020

(30) Foreign Application Priority Data

Jul. 9, 2018 (TW) ..... 107123632

(51) Int. Cl.
*F04B 39/00* (2006.01)
*F04B 39/14* (2006.01)
*F04B 33/00* (2006.01)

(52) U.S. Cl.
CPC ..... *F04B 33/005* (2013.01); *F04B 39/0022* (2013.01); *F04B 39/14* (2013.01)

(58) Field of Classification Search
CPC .... F04B 33/005; F04B 39/0022; F04B 39/14; F04B 2015/0812
See application file for complete search history.

(56) References Cited

U.S. PATENT DOCUMENTS 6,065,947 A * 5/2000 Wu ..... F04B 25/02 417/526
6,257,849 B1 7/2001 Wu
6,676,390 B2 * 1/2004 Wang ..... F04B 33/00 417/468
2001/0031211 A1 10/2001 Wu
2004/0169052 A1 9/2004 Wu
2015/0337821 A1 * 11/2015 Yang ..... F04B 33/005 417/259
2017/0184083 A1 * 6/2017 Wang ..... F16K 15/20
2017/0225528 A1 8/2017 Cheng

FOREIGN PATENT DOCUMENTS

CN 2714869 Y 8/2005
CN 101737290 A 6/2010
DE 202007000487 U1 4/2007

(Continued)

*Primary Examiner* — Devon C Kramer
*Assistant Examiner* — David N Brandt
(74) *Attorney, Agent, or Firm* — Bacon & Thomas, PLLC

(57) ABSTRACT

A mortise-tenon jointed air pump has a holding base, an inflation cylinder assembly, an inflation connector assembly, and an air pressure gauge. The holding base has a hollow housing. The inflation cylinder assembly is connected to an inlet end of the housing. The inflation connector assembly is mounted in an exhaust opening of the housing. The air pressure gauge is mounted in a pressure sensing portion of the holding base. The housing of the holding base and a connector of the inflation cylinder assembly are connected with each other by engaging at least one engaging protrusion in at least one engaging groove. Moreover, by inserting at least one retaining block through the housing and the connector, a relative position of the connector and the holding base is locked.

15 Claims, 14 Drawing Sheets

(56) References Cited

FOREIGN PATENT DOCUMENTS

| | | | |
|---|---|---|---|
| DE | 102008046865 | A1 | 3/2010 |
| DE | 202011000099 | U1 | 6/2011 |
| DE | 102013111199 | B3 | 10/2014 |
| TW | 423611 | | 2/2001 |
| TW | M566758 | U | 9/2018 |

* cited by examiner

MORTISE-TENON JOINTED AIR PUMP

CROSS-REFERENCE TO RELATED APPLICATIONS

This application is based upon and claims priority under 35 U.S.C. 119 from Taiwan Patent Application No. 107123632 filed on Jul. 9, 2018, which is hereby specifically incorporated herein by this reference thereto.

BACKGROUND OF THE INVENTION

1. Field of the Invention

The present invention relates to an air pump, especially to a mortise-tenon jointed air pump that is manually operated and is stably structure.

2. Description of the Prior Art(s)

Air pumps are common tools used in daily life. The air pumps are used for pressurizing air and inflating inflatable articles, such as balls or tires, with pressurized air.

With reference to FIGS. 12 to 14, a conventional air pump comprises a holding base 61, an inflation cylinder assembly 62, an air pressure gauge 64, a piston tube 65, and an inflation connector 66. An inner flow channel 611 is formed in and through the holding base 61. An end of the inflation cylinder assembly 62 and the holding base 61 are connected with each other via an external thread 621 and an internal thread 612, such that the inflation cylinder assembly 62 communicates with a first end of the inner flow channel 611. The air pressure gauge 64 is embedded in the holding base 61 and communicates with the inner flow channel 611 via a through hole 613 of the holding base 61. The piston tube 65 protrudes into the inner flow channel 611 of the holding base 61 through a second end of the inner flow channel 611. An inner end of the piston tube 65 is mounted with a piston 651. The piston 651 is slidably disposed in the inner flow channel 611. Moreover, the inner end of the piston tube 65 and the piston 651 are able to move into the inflation cylinder assembly 62. The inflation connector 66 is connected with an outer end of the piston tube 65.

Since the holding base 61 and the inflation cylinder assembly 62 are connected with each other via the internal thread 612 and the external thread 621, the holding base 61 and the inflation cylinder assembly 62 are easily loosed and separated from each other due to collision and shocks during transportation. When the conventional air pumps are sold in a store, the holding base 61 and the inflation cylinder assembly 62 are also easily loosed and separated from each other by being rotated by customers and even one or more components of the conventional air pump would be lost.

In addition, as shown in FIG. 14, since the air pressure gauge 64 communicates with the inner flow channel 611 via the through hole 613 of the holding base 61, when the piston 651 on the piston tube 65 is disposed between the first end of the inner flow channel 611 and the through hole 613 of the holding base 61, the air pressure gauge 64 and the inflation cylinder assembly is divided by the piston 651. Consequently, the air pressure gauge 64 is unable to detect air pressure developed by the inflation cylinder assembly 62. Only when the piston 651 on the piston tube 65 is disposed between the through hole 613 of the holding base 61 and the second end of the inner flow channel 611 can the air pressure gauge 64 communicates with the inflation cylinder assembly 62 via the through hole 613 of the holding base 61 and the inner flow channel 611 and detects the air pressure developed by the inflation cylinder assembly 62. Therefore, the conventional air pump is inconvenient for use.

To overcome the shortcomings, the present invention provides a mortise-tenon jointed air pump to mitigate or obviate the aforementioned problems.

SUMMARY OF THE INVENTION

The main objective of the present invention is to provide a mortise-tenon jointed air pump that has a holding base, an inflation cylinder assembly, at least one retaining block, an inflation connector assembly. The holding base includes a hollow housing, at least one engaging protrusion, and at least one outer fastening hole. The inflation cylinder assembly is connected to an inlet end of the housing and includes an outer tube, a one-way valve mounted to a front end of the outer tube, a connector securely attached to the front end of the outer tube, an inner tube mounted in the outer tube, a valve plate mounted in a fastening end of the inner tube, and a piston rod mounted through the rear end of the outer tube. The connector has at least one engaging groove and at least one inner fastening hole. The inflation connector assembly is mounted in an exhaust opening of the housing of the holding base.

The housing of the holding base and the connector of the inflation cylinder assembly are connected with each other by engaging the at least one engaging protrusion in the at least one engaging groove. Thus, the outer tube and the connector are unable to be drawn out from the holding base.

Each of the at least one retaining block is inserted into the inner fastening hole and the outer fastening hole that align with each other. Thus, the connector and the outer tube is unable to rotate relative to the holding base.

The mortise-tenon jointed air pump of the present invention does not disintegrate easily due to collision and shocks. Moreover, when the mortise-tenon jointed air pump is sold in a store, it is not easy for a customer to disassemble the mortise-tenon jointed air pump. Therefore, the mortise-tenon jointed air pump can remain complete.

In the aforementioned mortise-tenon jointed air pump: the holding base further includes an outer dividing tube disposed in the housing, and a pressure sensing portion for mounting an air pressure gauge; and the inflation connector assembly includes an inflation connector securely mounted in the exhaust opening of the housing.

Thus, the air pressure gauge can continue to detect air pressure developed by the inflation cylinder assembly without influenced by positions of a piston of the inflation connector assembly.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
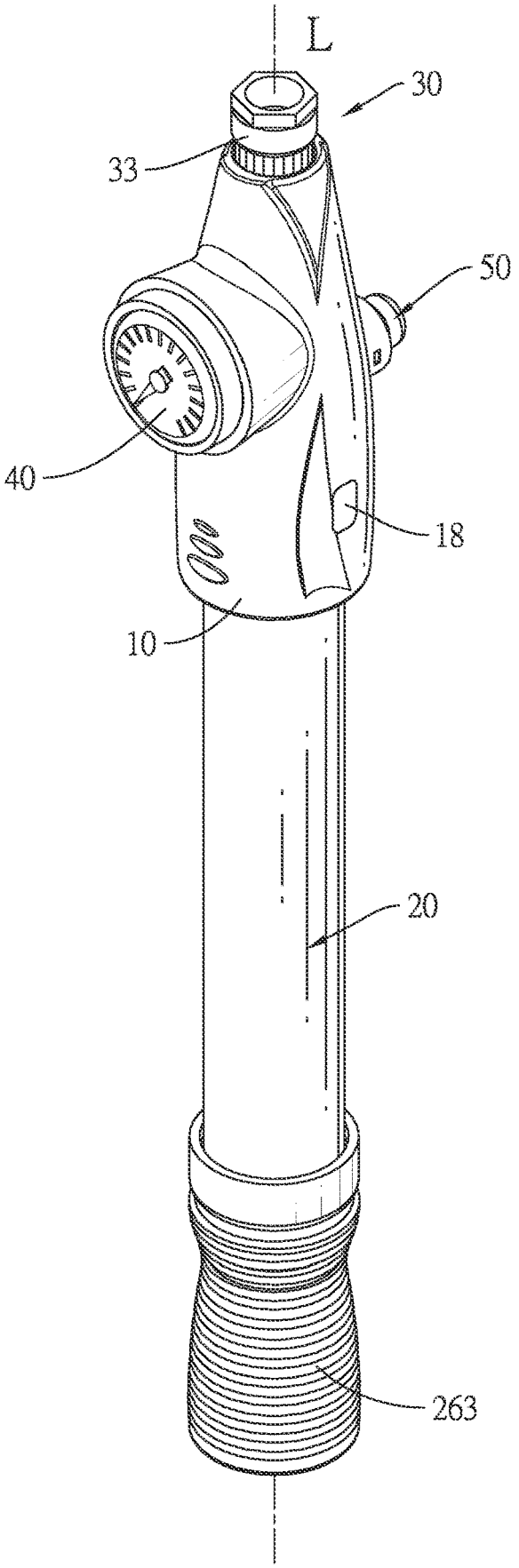
FIG. 1 is a perspective view of a mortise-tenon jointed air pump in accordance with the present invention.

With reference to FIG. 1, a first preferred embodiment of a mortise-tenon jointed air pump in accordance with the present invention comprises a holding base 10, an inflation cylinder assembly 20, at least one retaining block 18, an inflation connector assembly 30, an air pressure gauge 40, and a depressurizing assembly 50.

Figure 2:
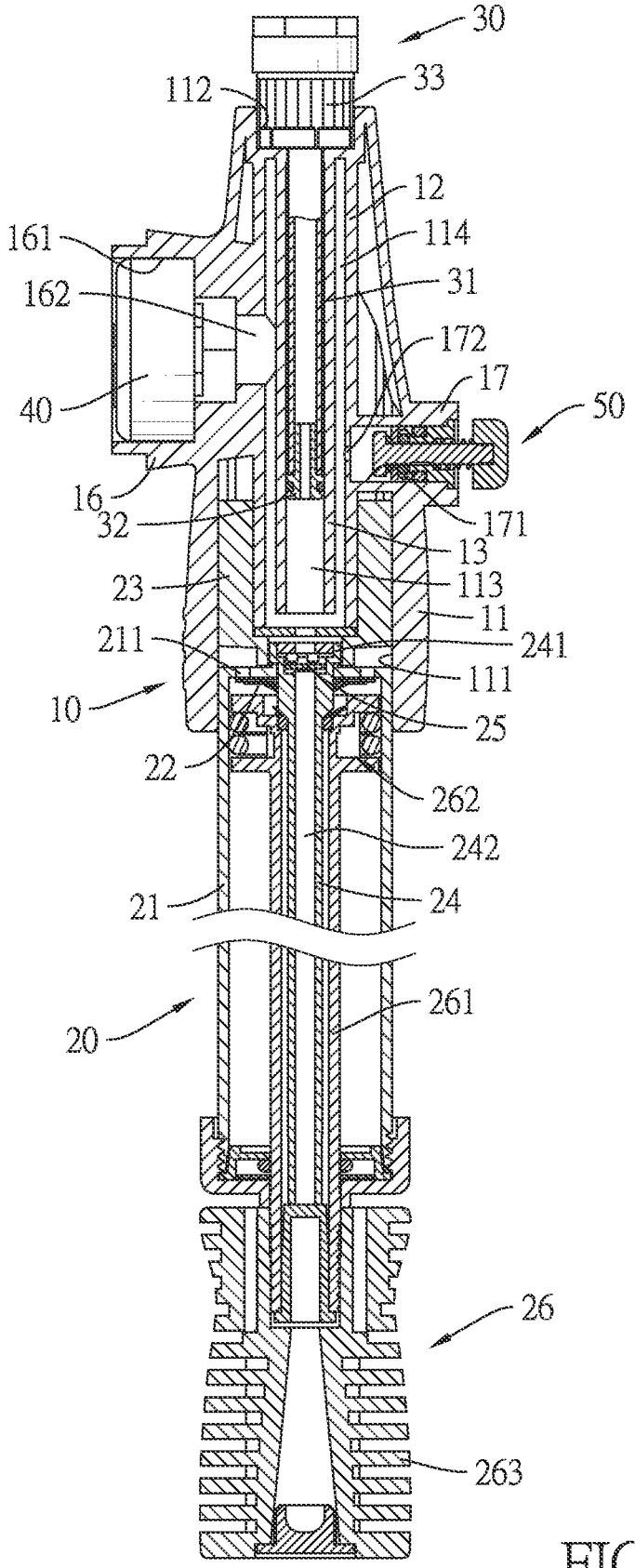
FIG. 2 is a cross-sectional side view of the mortise-tenon jointed air pump in FIG. 1, showing a piston of a inflation cylinder assembly being pushed forward.
Figure 4:
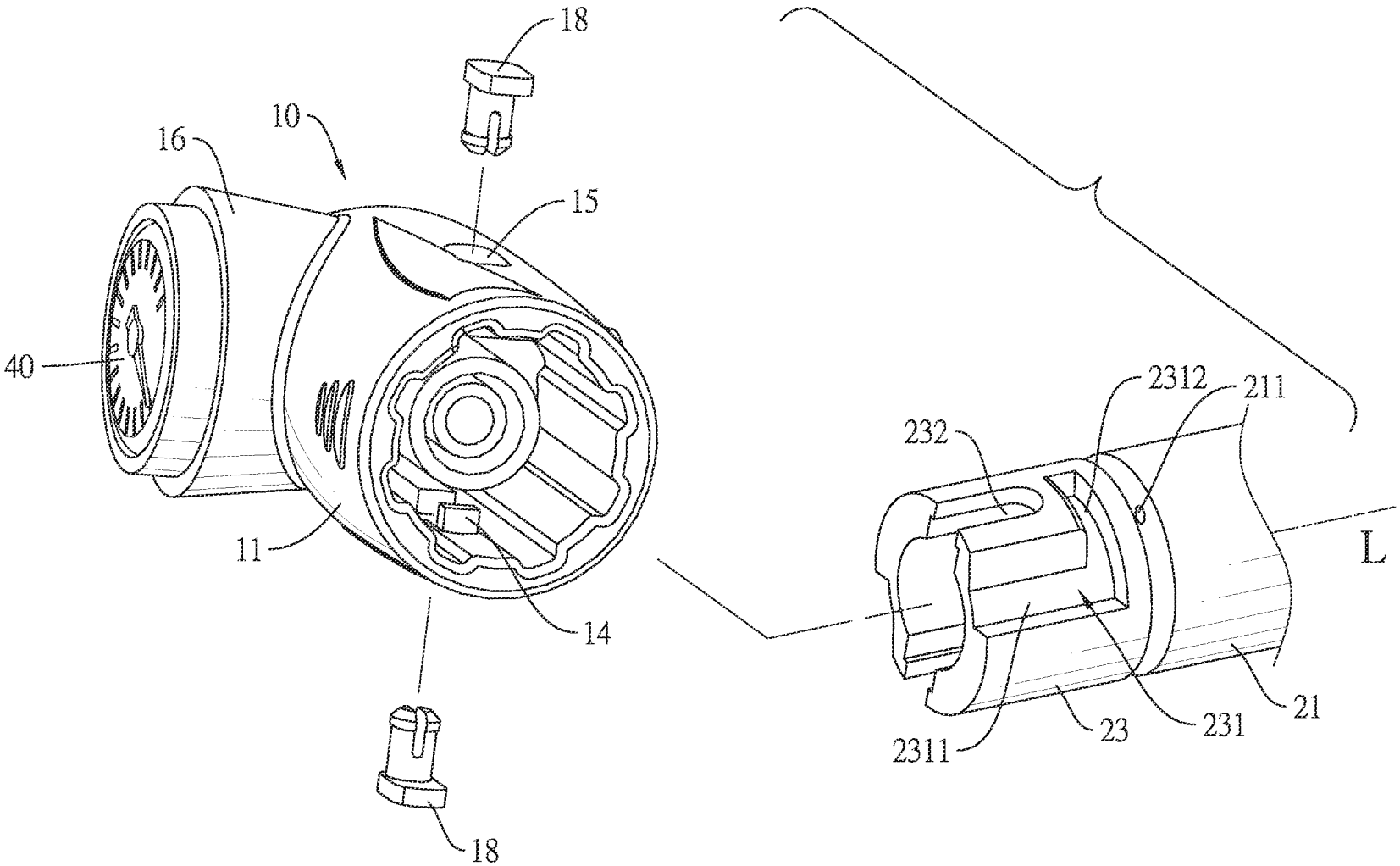
FIG. 4 is an enlarged exploded perspective view of a holding base and an outer tube and a connector of the inflation cylinder assembly of the mortise-tenon jointed air pump in FIG. 1.

With further reference to FIGS. 2 and 4, the holding base 10 includes a housing 11, an outer dividing tube 12, an inner dividing tube 13, at least one engaging protrusion 14, at least one outer fastening hole 15, a pressure sensing portion 16, and a depressurizing portion 17.

As shown in FIG. 2, the housing 11 is hollow and has an inlet end 111 and an exhaust opening 112. The inlet end 111 and the exhaust opening 112 are respectively formed in two ends of the housing 11. The outer dividing tube 12 is disposed in the housing 11 and has two opposite ends. One of the ends of the outer dividing tube 12 is positioned toward the inlet end 111. The other end of the outer dividing tube 12 is positioned toward the exhaust opening 112 and is connected with the housing 11 to form airtightness between the outer dividing tube 12 and the housing 11. The inner dividing tube 13 is disposed in the outer dividing tube 12 and has two opposite ends. One of the ends of the inner dividing tube 13 is positioned toward the inlet end 111. The other end of the inner dividing tube 13 is positioned toward the exhaust opening 112 and is connected with the housing 11 to form airtightness between the inner dividing tube 13 and the housing 11.

The outer dividing tube 12 and the inner dividing tube 13 divide an interior of the housing 11 into an inner flow channel 113 and an outer flow channel 114. The inner flow channel 113 is defined in the inner dividing tube 13 and directly and fluidly communicates with the exhaust opening 112 of the housing 11. The outer flow channel 114 is defined between the outer dividing tube 12 and the inner dividing tube 13. Since the end of the inner dividing tube 13, which is positioned toward the exhaust opening 112, is connected with the housing 11 to form airtightness between the inner dividing tube 13 and the housing, the outer flow channel 114 only directly and fluidly communicates with the inner flow channel 113 of the housing 11, such that the outer flow channel 114 indirectly and fluidly communicates with the exhaust opening 112 of the housing 11 via the inner flow channel 113.

As shown in FIG. 4, the at least one engaging protrusion 14 protrudes from an inner sidewall of the housing 11 and is disposed adjacent to the inlet end 111 of the housing 11. The at least one fastening hole 15 is formed through the housing 11 and is also disposed adjacent to the inlet end 111 of the housing 11.

As shown in FIG. 2 again, the pressure sensing portion 16 is formed on the housing 11 and has a mounting recess 161 and a first through hole 162. The mounting recess 161 is formed in the housing 11. The first through hole 162 fluidly-connects the mounting recess 161 and the outer flow channel 114. The depressurizing portion 17 is formed on the housing 11 and has a side channel 171 and a second through hole 172. The side channel 171 is formed in the housing 11. The second through hole 172 connects the side channel 171 and the outer flow channel 114.

Figure 3:
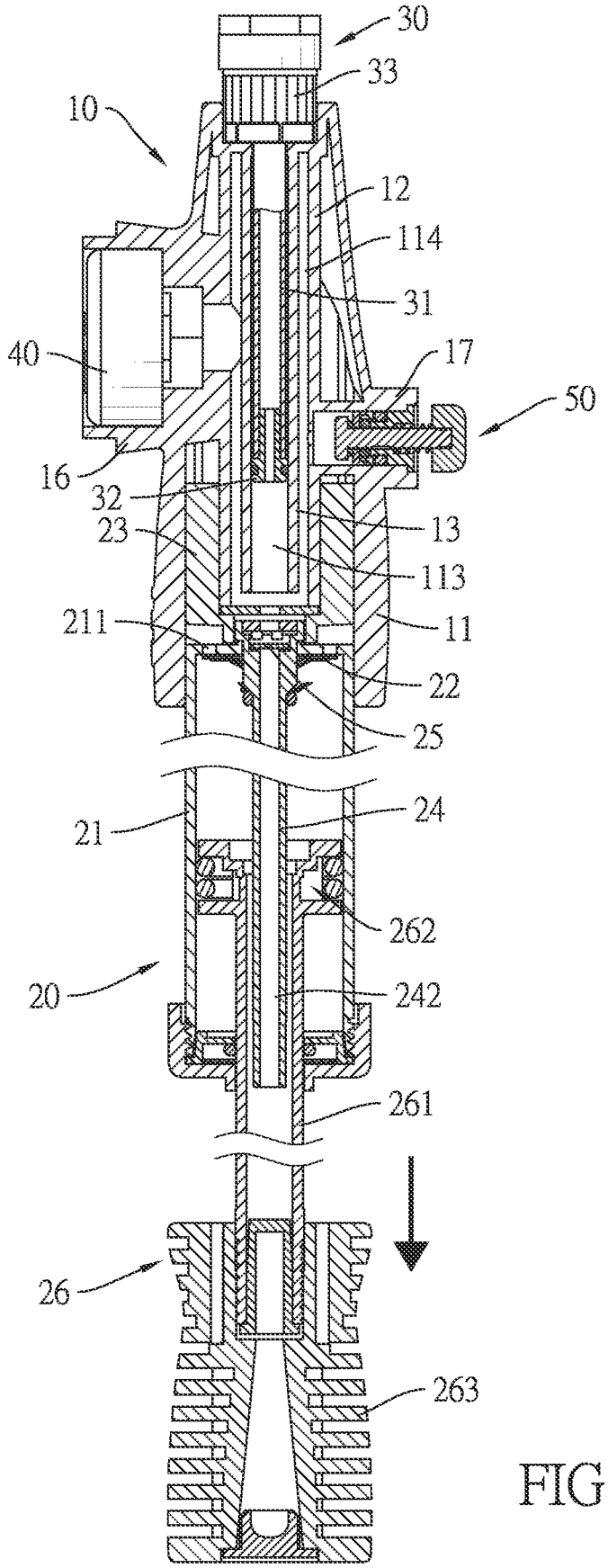
FIG. 3 is a cross-sectional side view of the mortise-tenon jointed air pump in FIG. 1, showing the piston of the inflation cylinder assembly being pulled backward.

With reference to FIGS. 2 and 3, the inflation cylinder assembly 20 is connected to the inlet end 111 of the housing 11 of the holding base 10 and includes an outer tube 21, a one-way valve 22, a connector 23, an inner tube 24, a valve plate 25, and a piston rod 26.

The outer tube 21 has a rear end, a front end, a front end surface, and at least one air inlet 211. The front end of the outer tube 21 is positioned toward the holding base 10. The at least one air inlet 211 is formed through the front end surface of the outer tube 21. The one-way valve 22 is mounted to the front end of the outer tube 21 and only allows air outside the outer tube 21 to flow into the outer tube 21 through the at least one air inlet 211. The air inside the outer tube 21 is unable to flow out of the outer tube 21 through the at least one air inlet 211.

With further reference to FIG. 4, the connector 23 is tubular, is securely attached to the front end of the outer tube 21, and communicates with the outer tube 21. The connector 23 has a front end, a rear end, at least one engaging groove 231, and at least one inner fastening hole 232. The rear end of the connector 23 is securely attached to the outer tube 21. The at least one engaging groove 231 is formed in an outer side surface of the connector 23. Each of the at least one engaging groove 231 is L-shaped and has an axial extending segment 2311 and a lateral extending segment 2312. The axial extending segment 2311 extends along a length direction parallel to an elongation axis L of the air pump and is formed through the front end of the connector 23. The lateral extending segment 2312 extends perpendicular to the axial extending segment 2311 and communicates with the axial extending segment 2311. The at least one inner fastening hole 232 is formed through the connector 23.

In the first preferred embodiment, the outer tube 21 and the connector 23 are manufactured as two separate parts and are securely connected with each other. In addition, the outer tube 21 and the connector 23 may be integrally formed as a single part. For instance, the outer tube 21 and the connector 23 may be manufactured by three-dimensional printing.

The inner tube 24 is mounted in the outer tube 21 and has a flow channel 242 and a fastening end 241. The flow channel 242 of the inner tube 24 is defined in the inner tube 24. The fastening end 241 is positioned toward the connector 23 and is securely connected with the front end of the outer tube 21.

Figure 5:
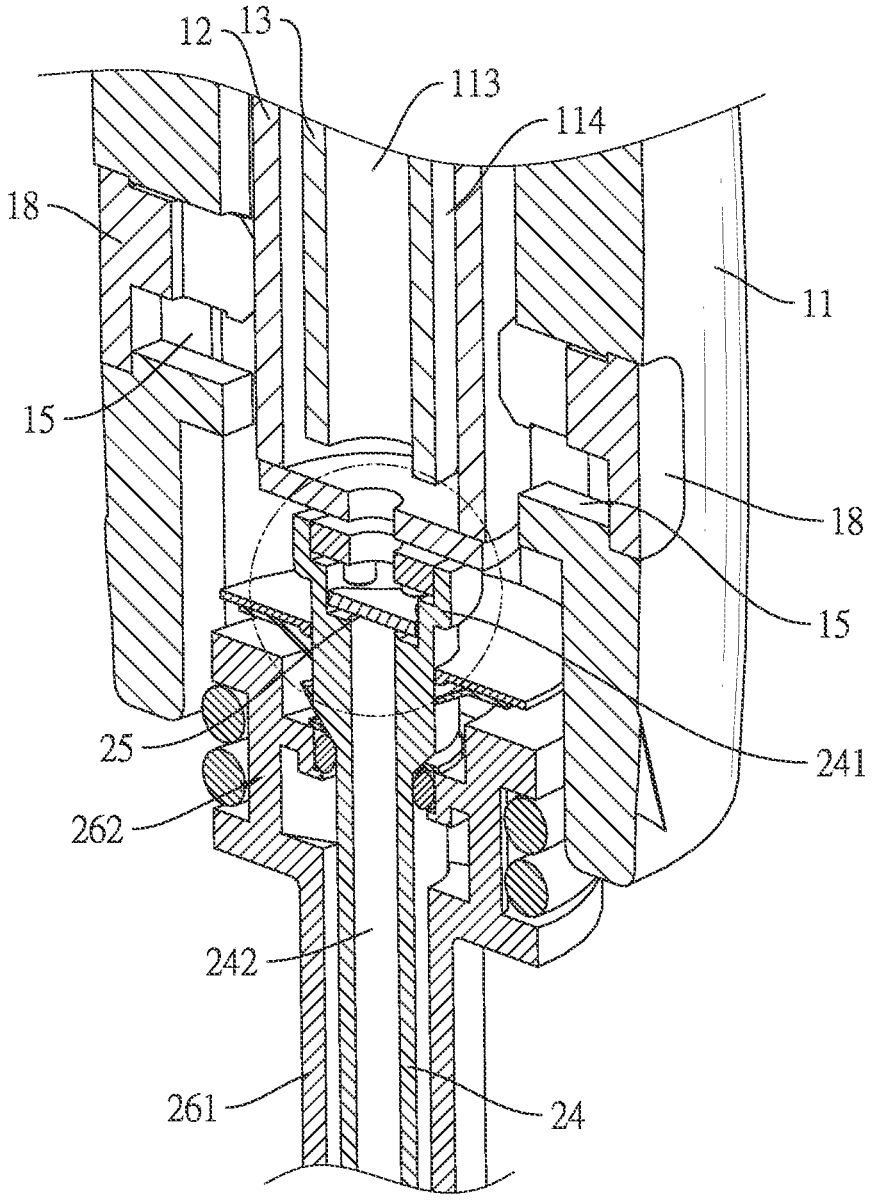
FIG. 5 is an enlarged cross-sectional perspective view of the holding base and an inner tube and a piston rod of the inflation cylinder assembly of the mortise-tenon jointed air pump in FIG. 1.
Figure 6:
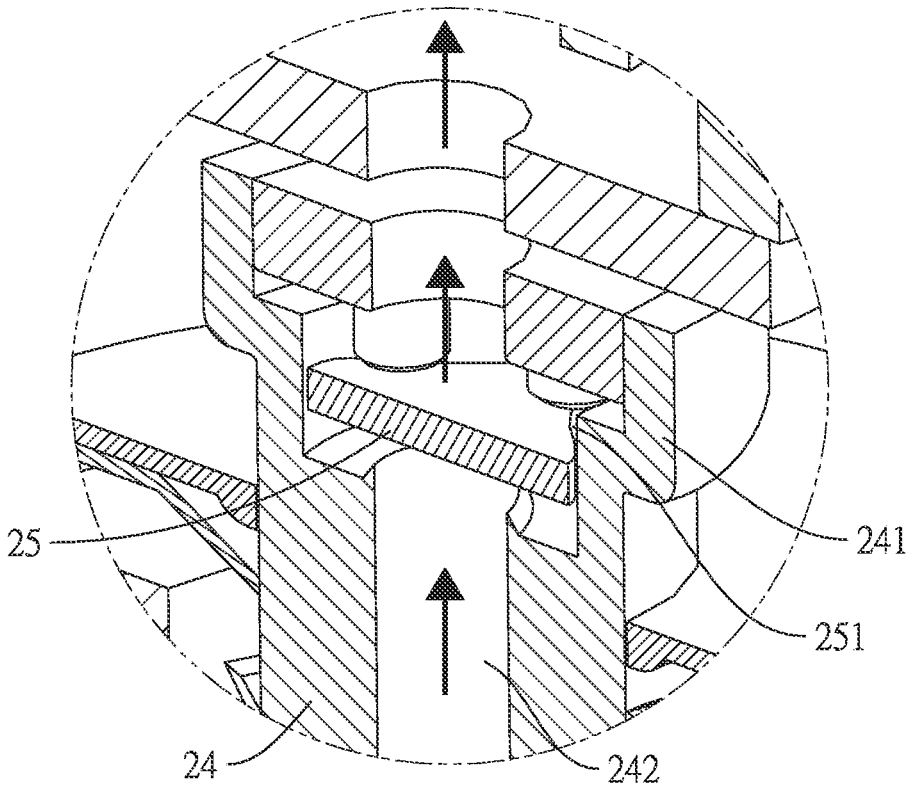
FIG. 6 is an enlarged cross-sectional perspective view of the inner tube of the inflation cylinder assembly of the mortise-tenon jointed air pump in FIG. 1, showing the inner tube being opened.
Figure 7:
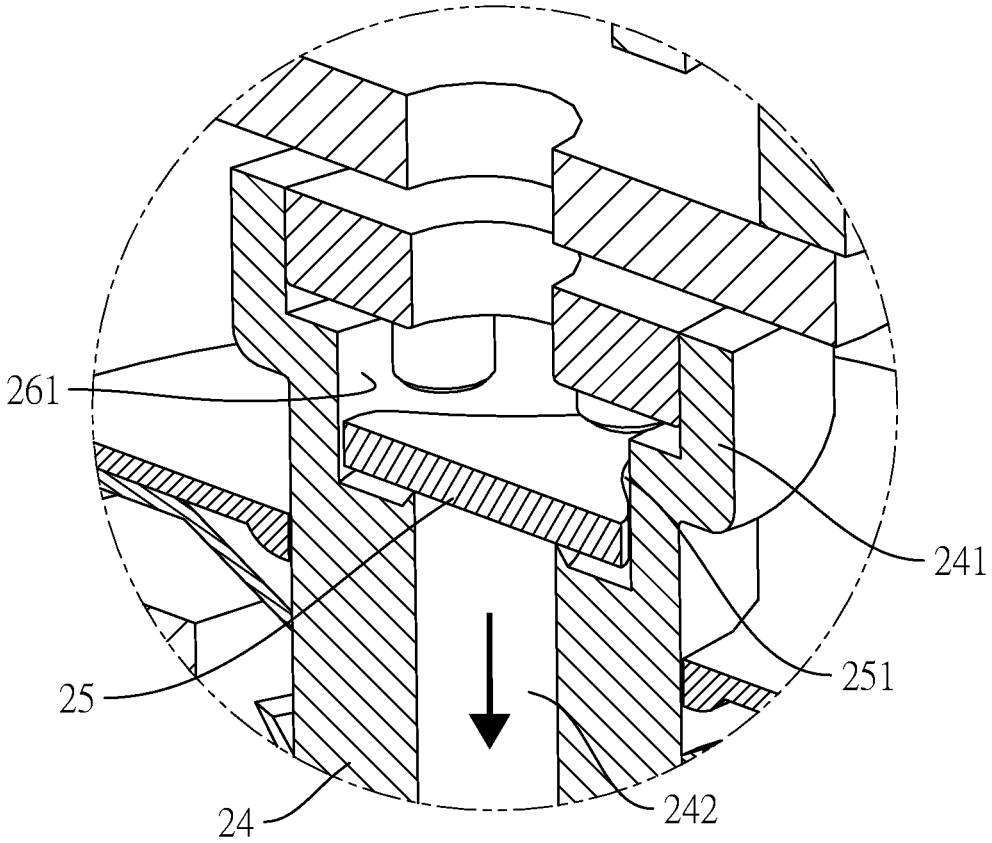
FIG. 7 is an enlarged cross-sectional perspective view of the inner tube of the inflation cylinder assembly of the mortise-tenon jointed air pump in FIG. 1, showing the inner tube being closed.

With further reference to FIGS. 5 to 7, the valve plate 25 is mounted in the fastening end 241 of the inner tube 24 and selectively closes the flow channel 242 of the inner tube 24. The valve plate 25 has a cross section perpendicular to the elongation axis L that is different from a corresponding cross section of an inner sidewall 261 defined in the fastening end of the inner tube.

The piston rod 26 is mounted through the rear end of the outer tube 21 and includes a rod body 261, a piston 262, and a handle 263. The rod body 261 is mounted through the rear end of the outer tube 21 and has an inner end and an outer end. The inner end of the rod body 261 protrudes into the outer tube 21. The inner tube 24 protrudes into the rod body 261 from the inner end of the rod body 261. The outer end of the rod body 261 protrudes out of the outer tube 21. The piston 262 is disposed on the inner end of the rod body 261 and abuts against an inner sidewall of the outer tube 21. The handle 263 is securely mounted on the outer end of the rod body 261.

A user can hold the holding base 10 with one hand and hold the handle 263 with the other hand to pull and push the piston rod 26. Thus, the piston 262 of the piston rod 262 slides back and forth in the outer tube 21 and between the outer tube 21 and the inner tube 24 along the elongation direction L of the air pump.

Figure 8:
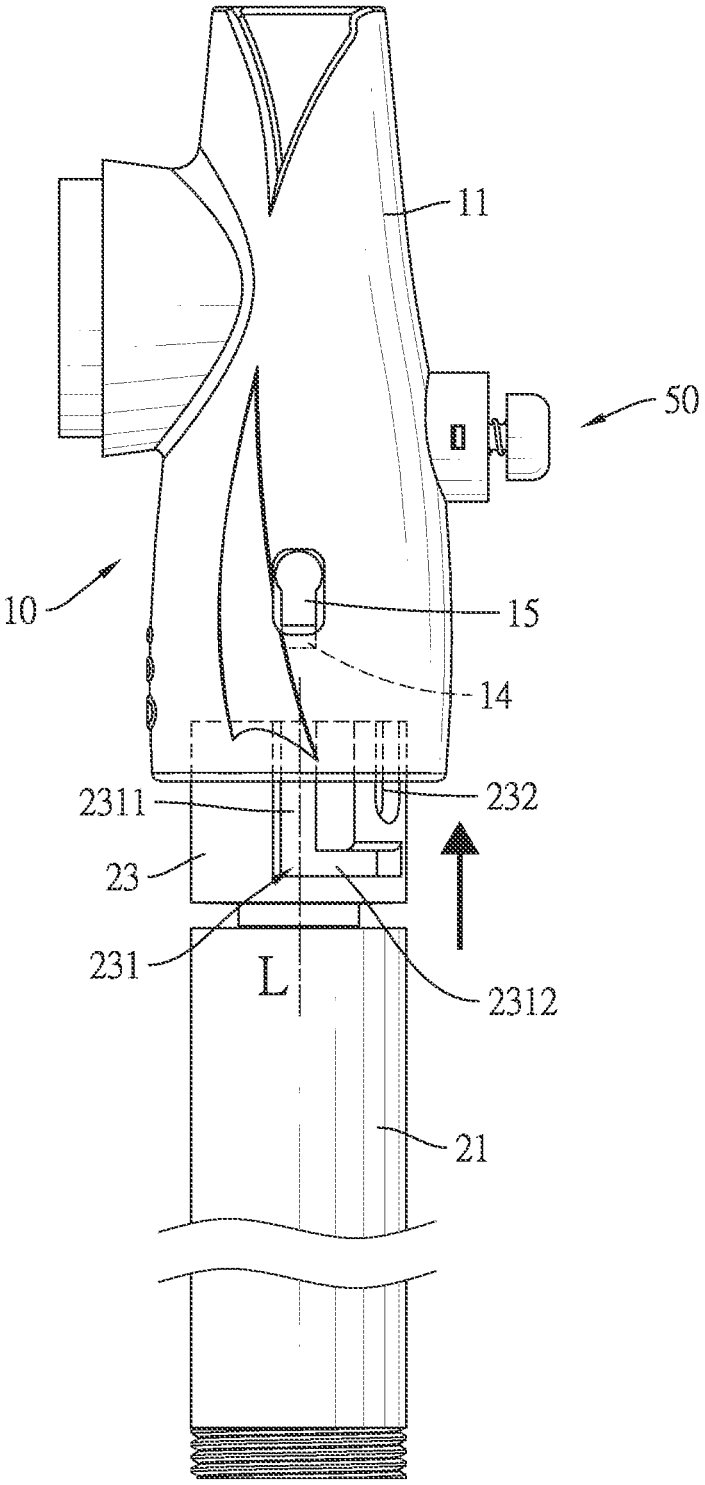
FIGS. 8 to 10 are operational side views of connecting the holding base and the connector of the inflation cylinder.
Figure 9:
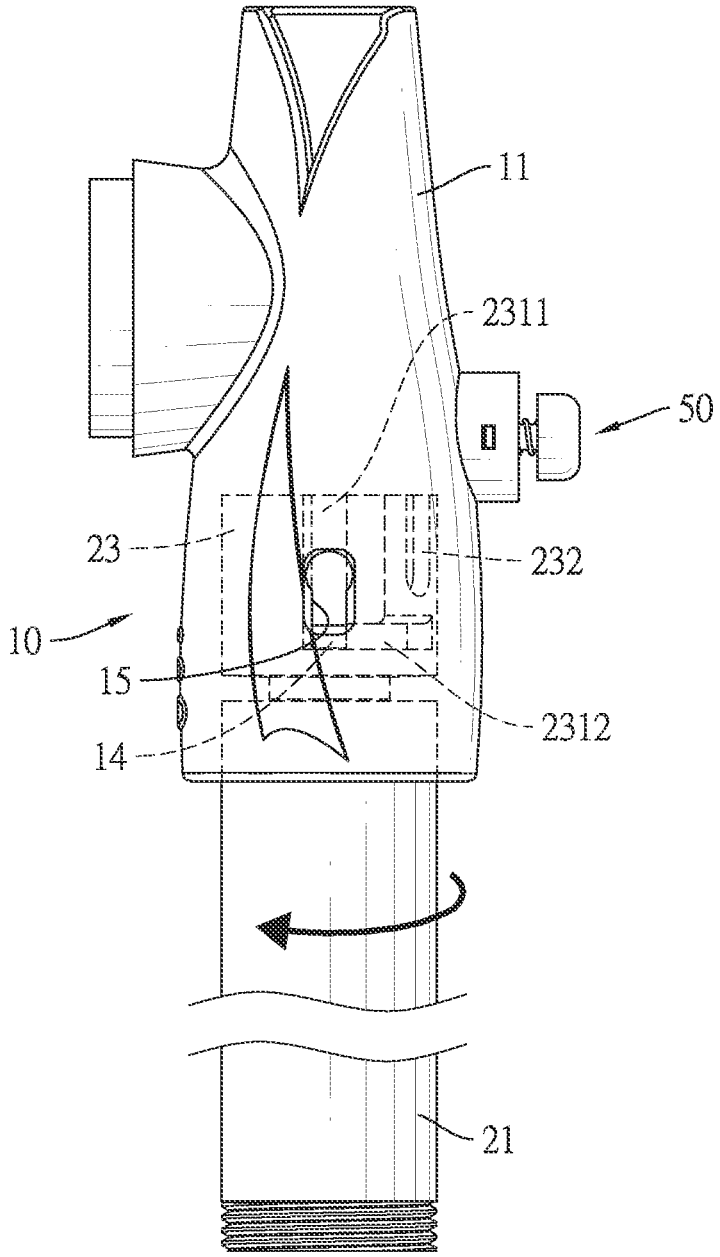
Figure 10:
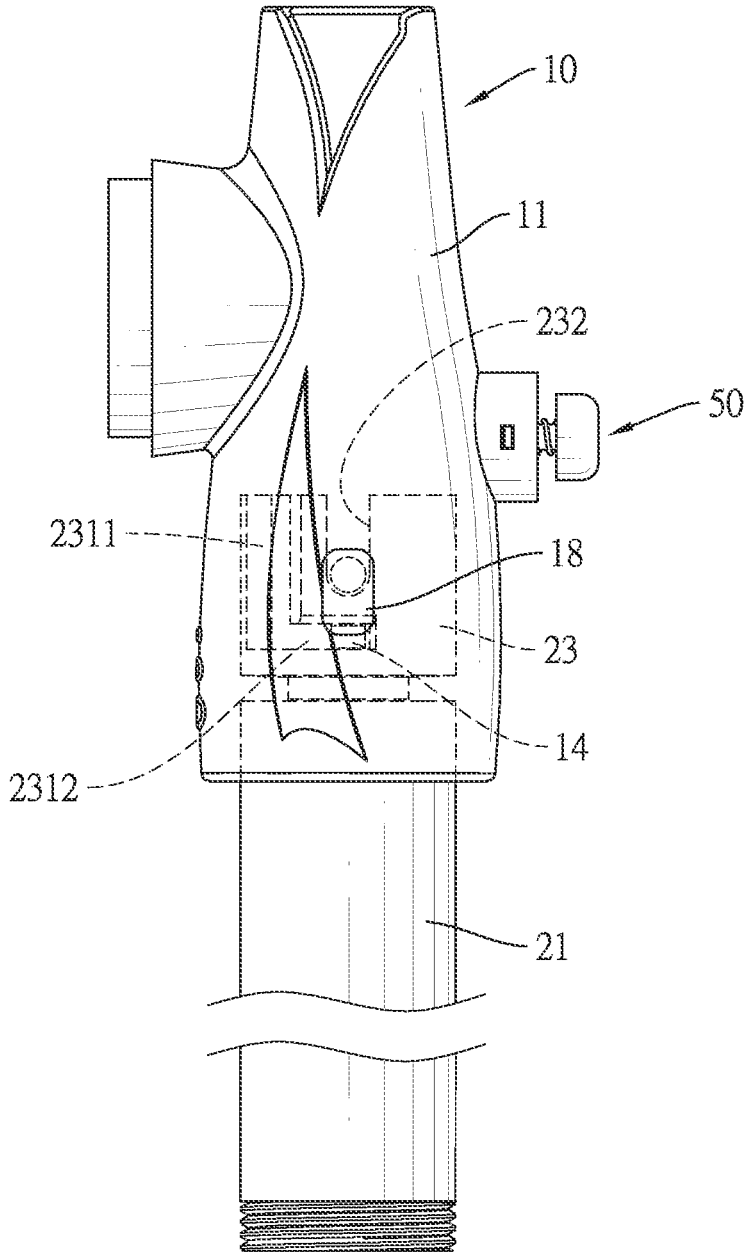

With further reference to FIGS. 8 and 9, when assembling the holding base 10 and the inflation cylinder assembly 20, the connector 23 is inserted into the housing 11 through the inlet end 111 of the housing 11. Thus, each of the at least one engaging protrusion 14 on the inner sidewall of the housing 11 moves along the axial extending segment 2311 of a corresponding one of the at least one engaging groove 231. With further reference to FIG. 10, then the outer tube 21 and the connector 23 are rotated relative to each other, such that each of the at least one engaging protrusion 14 moves along the lateral extending segment of the corresponding one of the at least one engaging groove 231. Thus, the outer tube 21 and the connector 23 are unable to be drawn out from the holding base 10.

Furthermore, when the at least one engaging protrusion 14 engages in the lateral extending segment 2312 of the at least one engaging groove 231, each of the at least one inner fastening hole 232 of the connector 23 aligns with a corresponding one of the at least one outer fastening hole 15 of the holding base 10. Each of the at least one retaining block 18 is inserted into the inner fastening hole 232 and the outer fastening hole 15 that align with each other, a relative position of the connector 23 and the holding base 10 is locked, so as to prevent the connector 23 and the outer tube 21 from rotating relative to the holding base 10. Accordingly, the outer tube 21 and the connector 23 do not separate from the holding base 10.

In the first preferred embodiment, the at least one engaging protrusion 14 of the holding base 10 includes two engaging protrusions 14, and the at least one outer fastening hole 15 of the holding base 10 includes two outer fastening holes 15. Correspondingly, the at least one engaging groove 231 of the connector 23 includes two engaging grooves 231 and the at least one inner fastening hole 232 of the connector 23 includes two inner fastening holes 232. The two engaging protrusions 14 are opposite from each other on the housing 10. When the two engaging protrusions 14 respectively engage in the lateral extending segments 2312 of the two engaging grooves 231, the two inner fastening holes 232 of the connector 23 align with the two outer fastening holes 15 of the holding base 10 respectively.

The inflation connector assembly 30 is mounted in the exhaust opening 112 of the housing 11 of the holding base 10 and includes a piston tube 31, a piston 32, and an inflation connector 33. The piston tube 31 slidably protrudes into the inner dividing tube 13 through the exhaust opening 112 and has an inner end and an outer end. The inner end of the piston tube 31 is positioned toward the inlet end 111 of the housing 11 and is disposed in the inner dividing tube 13. The outer end of the piston tube 31 is positioned toward the exhaust opening 112 of the housing 11 and selectively protrudes out of the exhaust opening 112. The piston 32 is mounted on the inner end of the piston tube 31 and is slidable in the inner dividing tube 13. The inflation connector 33 is mounted on the outer end of the piston tube 31 and is used for connecting an inflatable article.

The air pressure gauge 40 is mounted in the mounting recess 161 of the pressure sensing portion 16 on the housing 11 of the holding base 10. Since the mounting recess 161 fluidly communicates with the outer flow channel 114 of the housing 11 through the first through hole 162, the air pressure gauge 40 is able to detect air pressure value in the outer flow channel 114.

The depressurizing assembly 50 is mounted in the side channel 171 of the depressurizing portion 17 of the holding base 10. Since the side channel 171 fluidly communicates with the outer flow channel 114 through the second through hole 172, air inside the outer flow channel 114 can be exhausted by pressing the depressurizing assembly 50.

As shown in FIG. 3, when the piston rod 26 is pulled and the piston 262 slides toward the rear end of the outer tube 21, the air outside the outer tube 21 flows into the outer tube 21 through the at least one air inlet 211. With further reference to FIG. 2, when the piston rod 26 is pushed and the piston 262 slides toward the front end of the outer tube 21, the air inside the outer tube 21 is blocked by the one-way valve 22 and is unable to flow out of the outer tube 21. Thus, the air inside the outer tube 21 flows into the inner tube 24 via the hollow rod body 261, pushes the valve plate 25 to open the fastening end 241 of the inner tube 24, and then flows into the inner flow channel 113 and the outer flow channel 114 of the holding base 10. The air flowing into the inner flow channel 113 further inflates the inflatable article via the inflation connector assembly 30, and the air pressure gauge 40 detects the air pressure value in the outer flow channel 114. Moreover, when the depressurizing assembly 50 is pressed, the air inside the inflatable article is released from the depressurizing assembly 50 by flowing through the inflation connector assembly 30, the inner flow channel 113 and the outer flow channel 114. Accordingly, the air pressure inside the inflatable article can be adjusted.

The mortise-tenon jointed air pump as described has the following advantages. With the at least one engaging protrusion 14 of the holding base 10 engaging in the at least one engaging groove 231 of the connector 23 of the inflation cylinder assembly 20, the outer tube 21 and the connector 23 are unable to be drawn out from the holding base 10. Moreover, by inserting each of the at least one retaining block 18 into the inner fastening hole 232 and the outer fastening hole 15 that align with each other to lock the relative position of the connector 23 and the holding base 10, the connector 23 and the outer tube 21 is unable to rotate relative to the holding base 10. Therefore, the mortise-tenon jointed air pump of the present invention does not disintegrate easily due to collision and shocks. Moreover, when the mortise-tenon jointed air pump is sold in a store, it is not easy for a customer to disassemble the mortise-tenon jointed air pump. Therefore, the mortise-tenon jointed air pump can remain complete.

In addition, with the outer dividing tube 12 and the inner dividing tube 13 dividing the interior of the housing 11 into the inner flow channel 113 and the outer flow channel 114, the first through hole 162 of the pressure sensing portion 16 of the holding base 10 remains fluidly communicating with the outer flow channel 114 of the housing 11. Thus, the air pressure gauge 40 can continue to detect air pressure developed by the inflation cylinder assembly 20 and would not be influenced by positions of the piston 32 of the inflation connector assembly 30.

Figure 11:
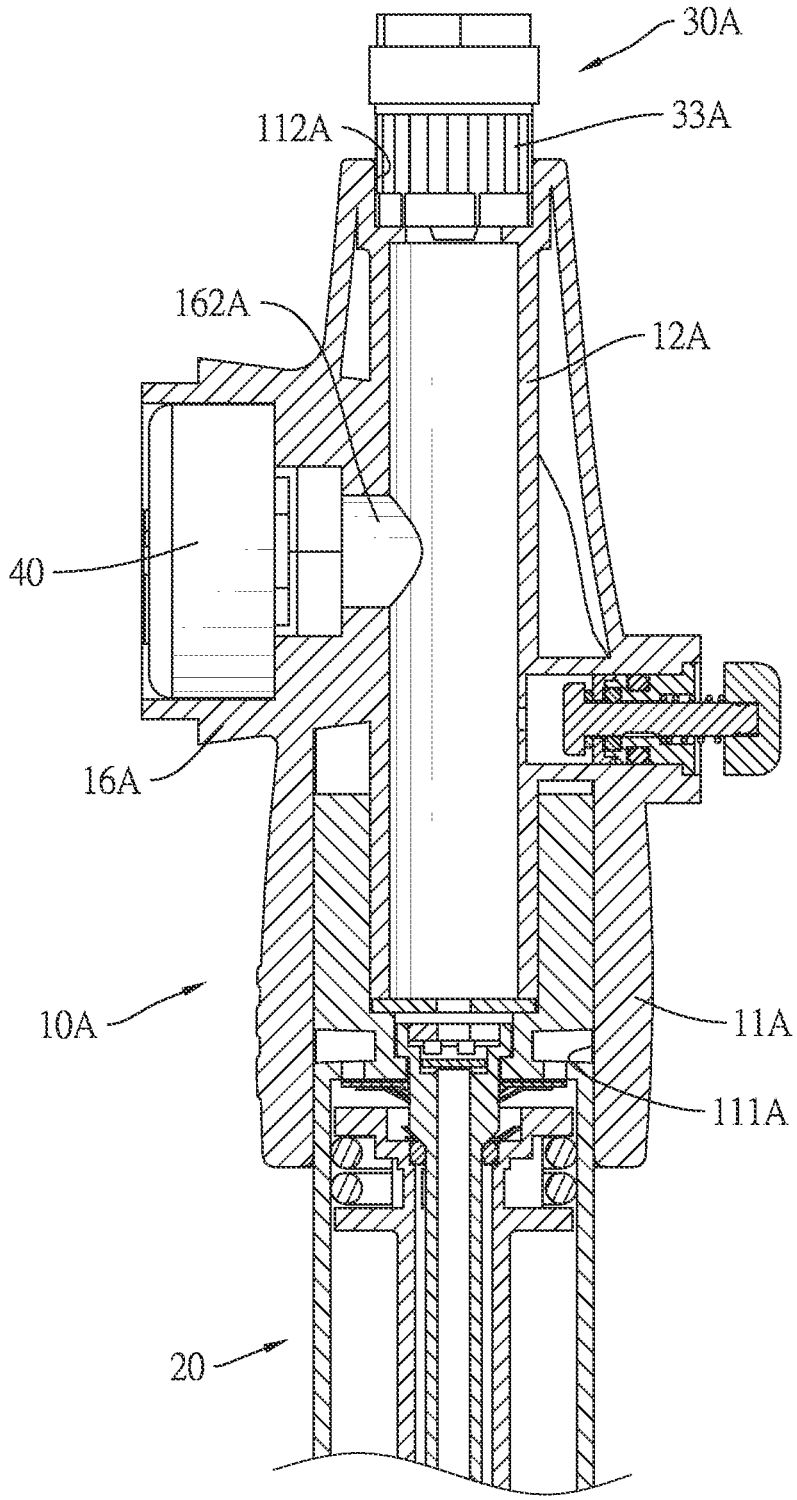
FIG. 11 is an enlarged cross-sectional side view of another embodiment of a mortise-tenon jointed air pump in accordance with the present invention.
Figure 12:
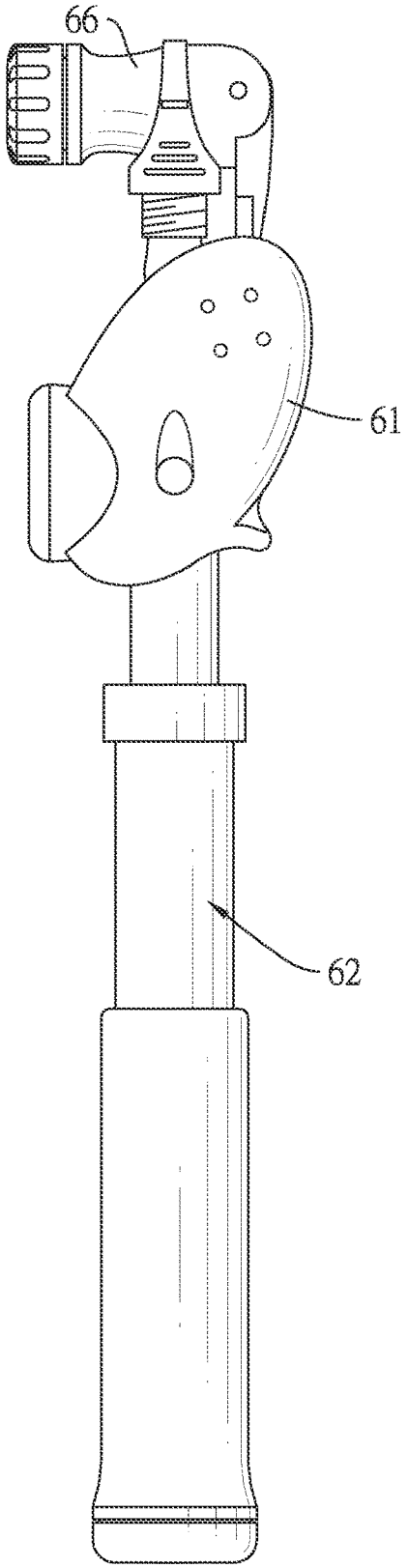
FIG.12 PRIOR ART
FIG. 12 is a side view of a conventional air pump in accordance with the prior art.
Figure 13:
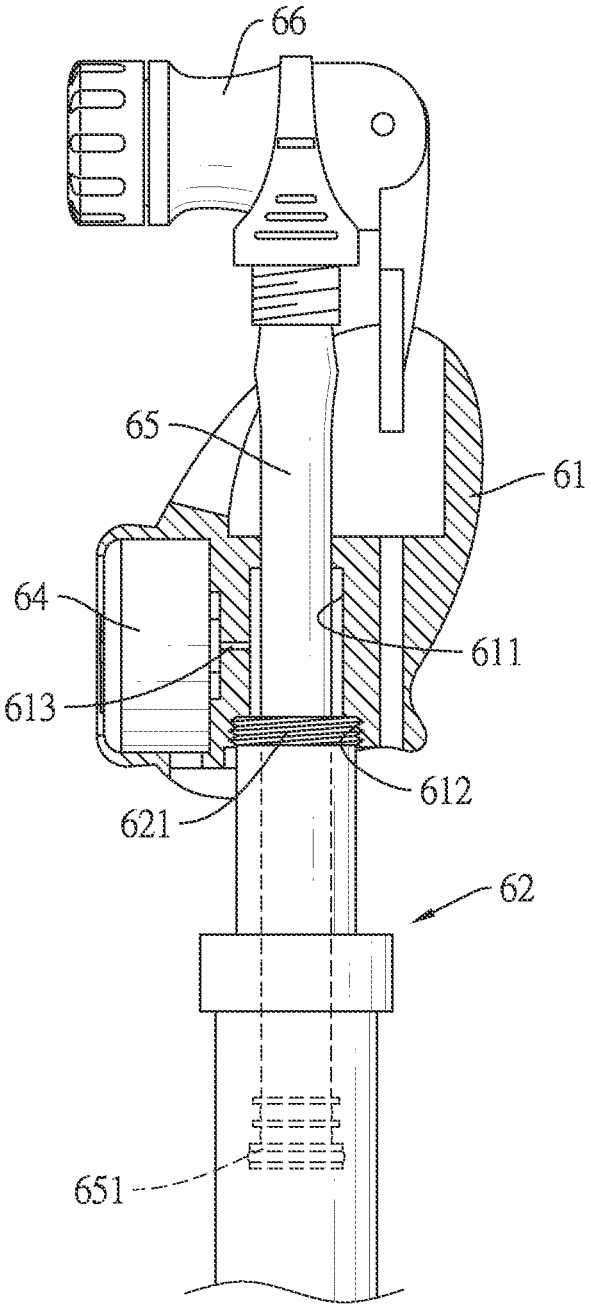
FIG.13 PRIOR ART
FIG. 13 is an enlarged side view in partial section of the conventional air pump in FIG. 12, showing a piston tube being retracted.
Figure 14:
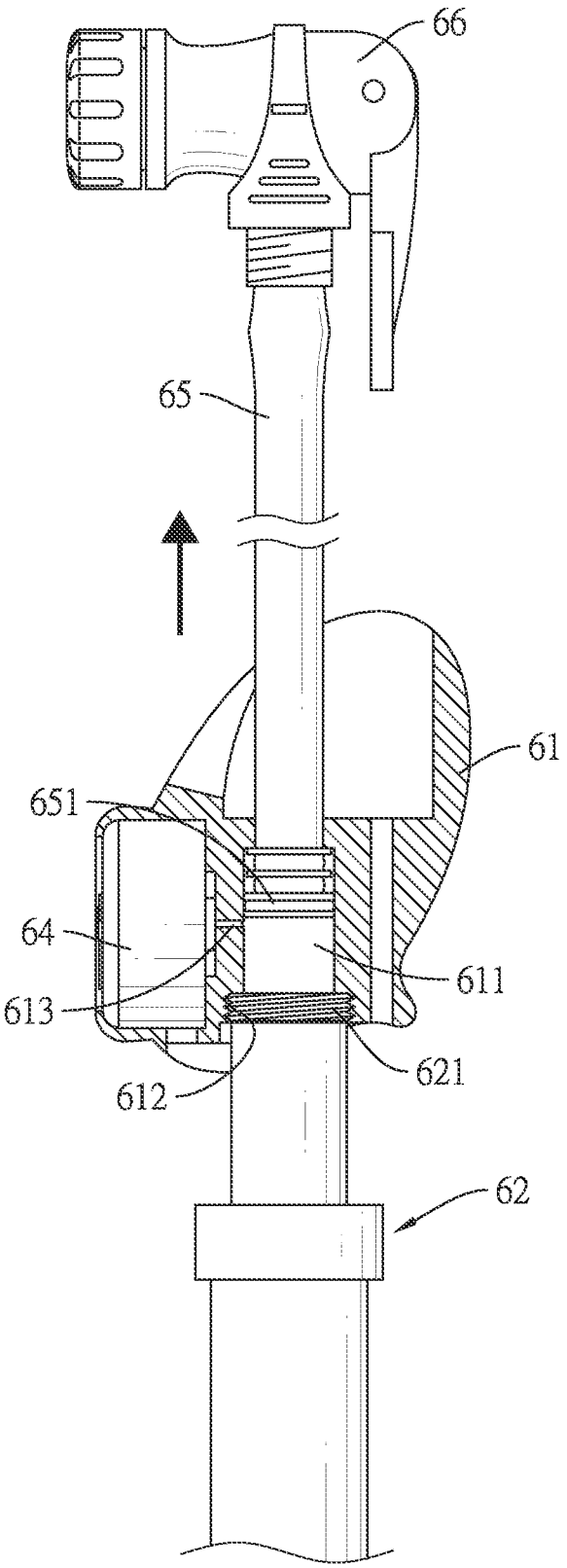
FIG.14 PRIOR ART
FIG. 14 is an enlarged side view in partial section of the conventional air pump in FIG. 12, showing the piston tube extending outward.

With further reference to FIG. 11, a second preferred embodiment of a mortise- tenon jointed air pump in accordance with the present invention is shown. The holding base 10A in the second preferred embodiment differs from the holding base 10 in the first preferred embodiment in that the inner dividing tube 13 is omitted and the inflation connector assembly 30A only includes an inflation connector 33A. The inflation connector 33A is securely mounted in the exhaust opening 112A of the housing 11A of the holding base 10A. Pressurized air developed by the inflation cylinder assembly 20 flows through the outer dividing tube 12A to inflate the inflatable article via the inflation connector 33A. The first through hole 162A of the pressure sensing portion 16A of the holding base 10A still fluidly communicates with the inlet end 111A of the housing 11A, so as to allow the air pressure gauge 40 in the pressure sensing portion 16A to detect the air pressure developed by the inflation cylinder assembly 20.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A mortise-tenon jointed air pump comprising:

a holding base including:

a housing being hollow and having an inlet end and an exhaust opening, and the inlet end and the exhaust opening respectively formed in two ends of the housing;

at least one engaging protrusion protruding from an inner sidewall of the housing and disposed adjacent to the inlet end of the housing; and at least one outer fastening hole formed through the housing and disposed adjacent to the inlet end of the housing;

an inflation cylinder assembly connected to the inlet end of the housing and including:

an outer tube having a rear end, a front end positioned toward the holding base, a front end surface, and at least one air inlet formed through the front end surface of the outer tube;

a one-way valve mounted to the front end of the outer tube and only allowing air outside the outer tube to flow into the outer tube through the at least one air inlet;

a connector being tubular securely attached to the front end of the outer tube, communicating with the outer tube, and having a front end, a rear end securely attached to the outer tube, at least one engaging groove formed in an outer side surface of the connector and at least one inner fastening hole formed through the connector, wherein each of the at least one engaging groove is L-shaped and has an axial extending segment extending along an elongation direction of the air pump and formed through the front end of the connector and a lateral extending segment extending perpendicular to the axial extending segment and communicating with the axial extending segment;

an inner tube mounted in the outer tube and having a flow channel defined in the inner tube and a fastening end positioned toward the connector and securely connected with the front end of the outer tube;

a valve plate disposed in the fastening end of the inner tube and selectively closing the flow channel of the inner tube; and a piston rod mounted through the rear end of the outer tube and including a rod body mounted through the rear end of the outer tube, the rod body having an inner end and an outer end, a piston disposed on the inner end of the rod body and abutting against an inner sidewall of the outer tube, and a handle securely mounted on the outer end of the rod body, wherein the inner tube protrudes into the rod body from the inner end of the rod body;

at least one retaining block; and an inflation connector assembly mounted in the exhaust opening of the housing of the holding base;

wherein the connector is inserted into the housing through the inlet end of the housing, each of the at least one engaging protrusion on the inner sidewall of the housing moves along the axial extending segment of a corresponding one of the at least one engaging groove, and then the outer tube and the connector are rotated relative to each other, such that each of the at least one engaging protrusion moves along the lateral extending segment of the corresponding one of the at least one engaging groove; and the at least one engaging protrusion engages in the lateral extending segment of the at least one engaging groove, each of the at least one inner fastening hole of the connector aligns with a corresponding one of the at least one outer fastening hole of the holding base, and each of the at least one retaining block is inserted into the inner fastening hole and the outer fastening hole that align with each other.

2. The mortise-tenon jointed air pump as claimed in claim 1, wherein the holding base further includes:

an outer dividing tube disposed in the housing and having two opposite ends, one of the ends of the outer dividing tube positioned toward the inlet end, and the other end of the outer dividing tube positioned toward the exhaust opening and connected with the housing to form airtightness between the outer dividing tube and the housing;

an inner dividing tube disposed in the outer dividing tube and having two opposite ends, one of the ends of the inner dividing tube positioned toward the inlet end, and the other end of the inner dividing tube positioned toward the exhaust opening and connected with the housing to form airtightness between the inner dividing tube and the housing;

an inner flow channel defined in the inner dividing tube and directly and fluidly communicating with the exhaust opening of the housing;

an outer flow channel defined between the outer dividing tube and the inner dividing tube, directly and fluidly communicating with the inner flow channel of the housing, and indirectly and fluidly communicating with the exhaust opening of the housing via the inner flow channel; and a pressure sensing portion formed on the housing and having a mounting recess formed in the housing and a first through hole fluidly connecting the mounting recess and the outer flow channel;

the inflation connector assembly includes:

a piston tube slidably protruding into the inner dividing tube through the exhaust opening;

a piston mounted on an inner end of the piston tube and being slidable in the inner dividing tube; and an inflation connector mounted on an outer end of the piston tube; and the mortise-tenon jointed air pump further comprises an air pressure gauge mounted in the mounting recess of the pressure sensing portion on the housing.

3. The mortise-tenon jointed air pump as claimed in claim 2, wherein the holding base further includes a depressurizing portion formed on the housing and having:

a side channel formed in the housing; and a second through hole connects the side channel and the outer flow channel; and the mortise-tenon jointed air pump further comprises a depressurizing assembly mounted in the side channel of the depressurizing portion of the holding base.

4. The mortise-tenon jointed air pump as claimed in claim 1, wherein the holding base further includes:

an outer dividing tube disposed in the housing and having two opposite ends, one of the ends of the outer dividing tube positioned toward the inlet end, and the other end of the outer dividing tube positioned toward the exhaust opening and connected with the housing to form airtightness between the outer dividing tube and the housing; and a pressure sensing portion formed on the housing and having a mounting recess formed in the housing and a first through hole fluidly connecting the mounting recess and the outer dividing tube;

the inflation connector assembly includes an inflation connector securely mounted in the exhaust opening of the housing of the holding base; and the mortise-tenon jointed air pump further comprises an air pressure gauge mounted in the mounting recess of the pressure sensing portion of the holding base.

5. The mortise-tenon jointed air pump as claimed in claim 4, wherein the holding base further includes a depressurizing portion formed on the housing and having:

a side channel formed in the housing; and a second through hole connects the side channel and the outer dividing tube; and the mortise-tenon jointed air pump further comprises a depressurizing assembly mounted in the side channel of the depressurizing portion of the holding base.

6. The mortise-tenon jointed air pump as claimed in claim 1, wherein the at least one engaging protrusion of the housing includes two engaging protrusions; and the at least one engaging groove of the connector includes two engaging grooves.

7. The mortise-tenon jointed air pump as claimed in claim 2, wherein the at least one engaging protrusion of the housing includes two engaging protrusions; and the at least one engaging groove of the connector includes two engaging grooves.

8. The mortise-tenon jointed air pump as claimed in claim 4, wherein the at least one engaging protrusion of the housing includes two engaging protrusions; and the at least one engaging groove of the connector includes two engaging grooves.

9. The mortise-tenon jointed air pump as claimed in claim 6, wherein the at least one outer fastening hole of the holding base includes two outer fastening holes; and the at least one inner fastening hole of the connector includes two inner fastening holes.

10. The mortise-tenon jointed air pump as claimed in claim 7, wherein the at least one outer fastening hole of the holding base includes two outer fastening holes; and the at least one inner fastening hole of the connector includes two inner fastening holes.

11. The mortise-tenon jointed air pump as claimed in claim 8, wherein the at least one outer fastening hole of the holding base includes two outer fastening holes; and the at least one inner fastening hole of the connector includes two inner fastening holes.

12. The mortise-tenon jointed air pump as claimed in claim 6, wherein the two engaging protrusions are opposite from each other on the housing.

13. The mortise-tenon jointed air pump as claimed in claim 7, wherein the two engaging protrusions are opposite from each other on the housing.

14. The mortise-tenon jointed air pump as claimed in claim 8, wherein the two engaging protrusions are opposite from each other on the housing.

15. The mortise-tenon jointed air pump according to claim 1, wherein the valve plate has a cross section perpendicular to the elongation axis that is different from a corresponding cross section of an inner sidewall defined in the fastening end of the inner tube.

* * * * *